US005699933A

United States Patent [19]

Ho et al.

[11] Patent Number: 5,699,933

[45] Date of Patent: Dec. 23, 1997

[54] VALVE FOR A WATER DISPENSER FOR BICYCLISTS

[75] Inventors: Kuo-Ping Ho, P.O. Box 82-144, Taipei; Ping-Lien Chienp, Taipei Hsien, both of Taiwan

[73] Assignee: Kuo-Ping Ho, Taiwan

[21] Appl. No.: 761,894

[22] Filed: Dec. 9, 1996

[51] Int. Cl.[6] ..... B65D 51/18

[52] U.S. Cl. ..... 220/703; 220/714; 220/715; 222/508; 222/518

[58] Field of Search ..... 220/703, 714, 220/715; 222/508, 518, 545, 563

[56] References Cited

U.S. PATENT DOCUMENTS

| | | | |
|---|---|---|---|
| 2,210,206 | 8/1940 | Fisher | 220/714 |
| 3,840,153 | 10/1974 | Devlin | 220/146 |
| 5,295,597 | 3/1994 | Green | 220/714 |
| 5,427,271 | 6/1995 | Wang | 220/714 |
| 5,495,966 | 3/1996 | Won | 222/508 |

*Primary Examiner*—Joseph M. Moy
*Attorney, Agent, or Firm*—A & J

[57] ABSTRACT

A valve for a water dispenser including a housing, a resilient member, a slide, a button, a O-ring and an inlet connector, wherein the resilient and slide are fitted within the housing and the inlet connection is engaged with an outer end of the housing, characterized in that when the button is pressed by the teeth of an user, the slide will be forced to go further into the housing thereby moving an O-ring 34 away from the circular recess of the inlet connector and therefore enabling water to flow through the passage of the inlet connector and the interior of the housing into the mouth of the user.

2 Claims, 7 Drawing Sheets

VALVE FOR A WATER DISPENSER FOR BICYCLISTS

BACKGROUND OF THE INVENTION

1. Field of the Invention

This invention relates to an improved valve for a water dispenser for bicyclists.

2. Description of the Prior Art

Many attempts have been made to provide a water dispenser for bicyclists. Nevertheless, all water dispensers for bicyclists on the market are impractical and inconvenient to use.

U.S. Pat. No. 5,060,833 to Edison et al, entitled "CAMEL BACK", discloses a water system which includes a water container provided with a filler neck 2 having a removable closure member 3 and a mouthpiece 5 connected with the water container via a tube 4 (see FIG. 1A). The mouthpiece 5 is a tubular member in which are fitted a ball 5A and a spring 5B (see FIG. 1B). When the mouthpiece 5 is bitten down upon, the ball 5A is forced back thus allowing the water to pass therethrough. When the pressure on the mouthpiece is released, the spring 5B returns the ball 5A into the seated position.

U.S. Pat. No. 5,085,349 to Fawcett, entitled "RESILIENT VALVE AND DISPENSING SYSTEM FOR BICYCLISTS", discloses a unitary resilient valve device which includes a water container 100 provided with a filler neck 200 having a removable closure member 300 and a mouthpiece 600 connected with the water container via a tube 400 (see FIG. 2A). The mouthpiece 600 is a tubular member formed with a slit 4200 (see FIG. 2B). The slit 4200 will be forced open when the mouthpiece 600 is compressed between teeth (see FIGS. 2C and 2D).

However, these two patents still suffer from the following drawbacks:

1. The prior art mouthpiece shown in FIGS. 1A and 1B is a tubular member in which are fitted a ball and a spring. However, as the ball and the spring are made of metal and disposed within the tubular member, it will be impossible for the user to know whether the ball and the spring are rusted or not.

2. The user must apply a relatively large biting force to overcome the resiliency of the mouthpiece and the spring in order to force back the ball to let water to pass therethrough on one hand and suck the mouthpiece simultaneously on the other hand, thereby making it very difficult to control.

3. Water will be squeezed out of the water containers of the prior art water dispensers even if they are inadvertently compressed thus making it inconvenient to use.

Therefore, it is an object of the present invention to provide an improved valve for a water dispenser for bicyclists which can obviate and mitigate the above-mentioned drawbacks.

SUMMARY OF INVENTION

This invention relates to an improved valve for a water dispenser for bicyclists.

It is the primary object of the present invention to provide an improved valve for a water dispenser for bicyclists which is easy to use.

It is another object of the present invention to provide an improved valve for a water dispenser for bicyclists which will not dispense water even if the water bag is inadvertently compressed.

It is still another object of the present invention to provide an improved valve for a water dispenser for bicyclists which can be easily replaced thereby enabling the water dispenser to be used by different persons without worrying about sanitary condition.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1A:
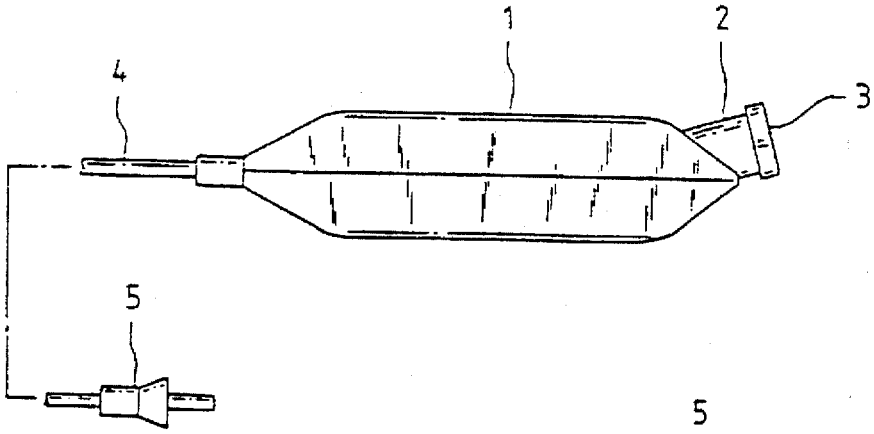
PRIOR ART FIG. 1A
FIG. 1A shows a prior art water dispenser for bicyclists.
Figure 1B:
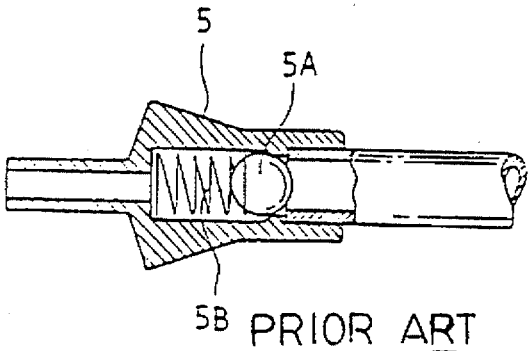
PRIOR ART FIG. 1B
FIG. 1B is a sectional view of the mouthpiece shown in FIG. 1.
Figure 2A:
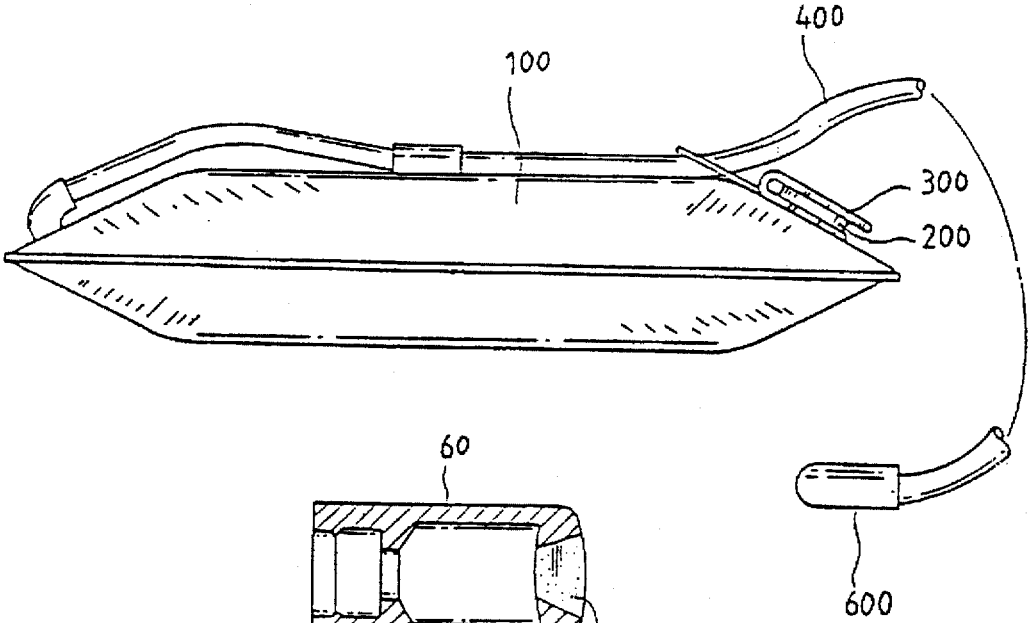
PRIOR ART FIG. 2A
FIG. 2A shows another prior art water dispenser for bicyclists.
Figure 2B:
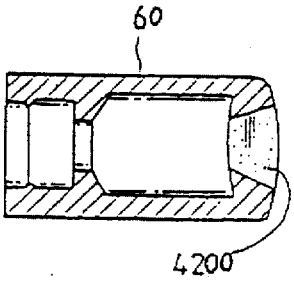
PRIOR ART FIG. 2B
FIG. 2B is a sectional view of the mouthpiece shown in FIG. 2A.
Figure 2D:
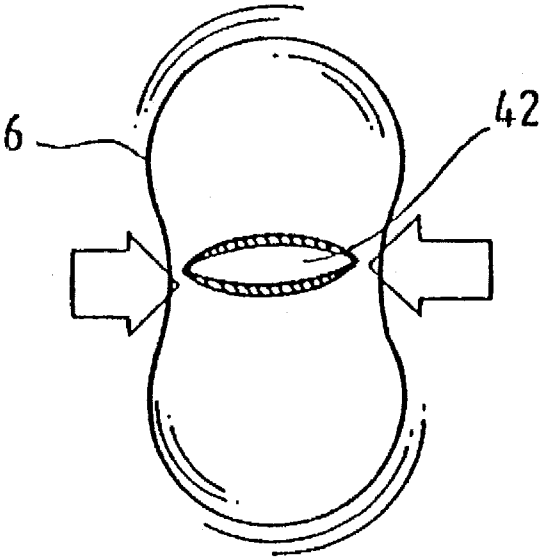
PRIOR ART FIG. 2D
FIG. 2D illustrates how the mouthpice shown in FIG. 2A is pressed open.
Figure 2C:
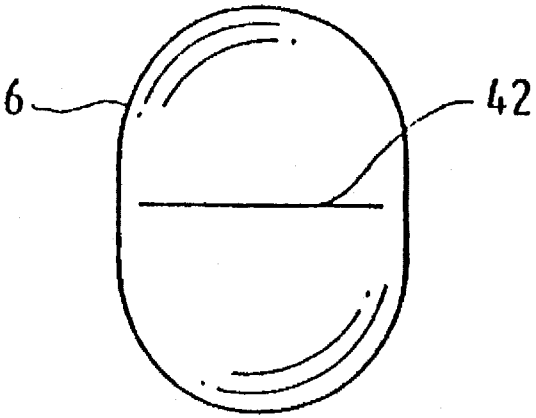
PRIOR ART FIG. 2C
FIG. 2C is a front view of the mouthpiece shown in FIG. 2A.
Figure 3:
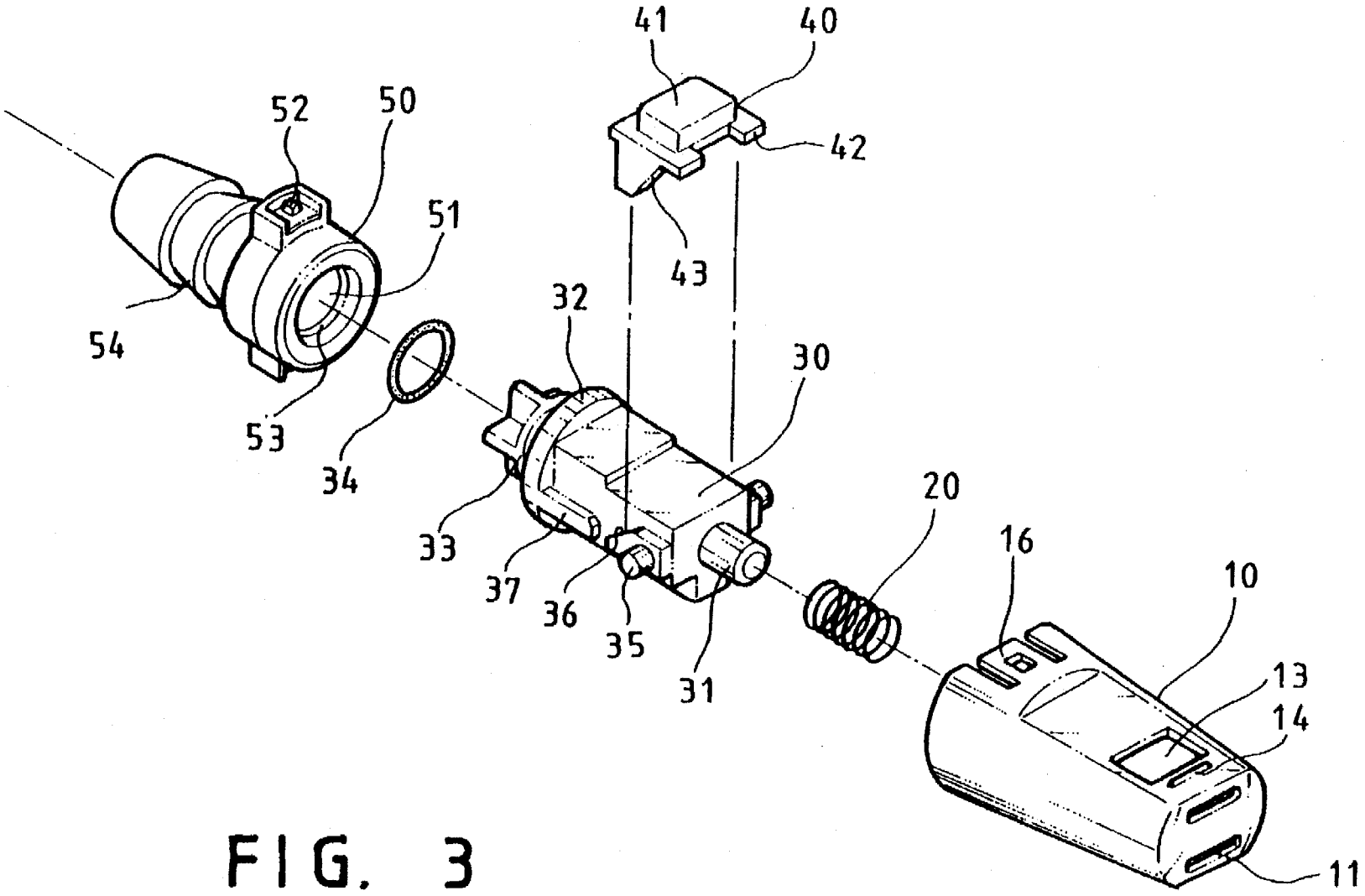
FIG. 3 is an exploded view of the present invention.
Figure 4:
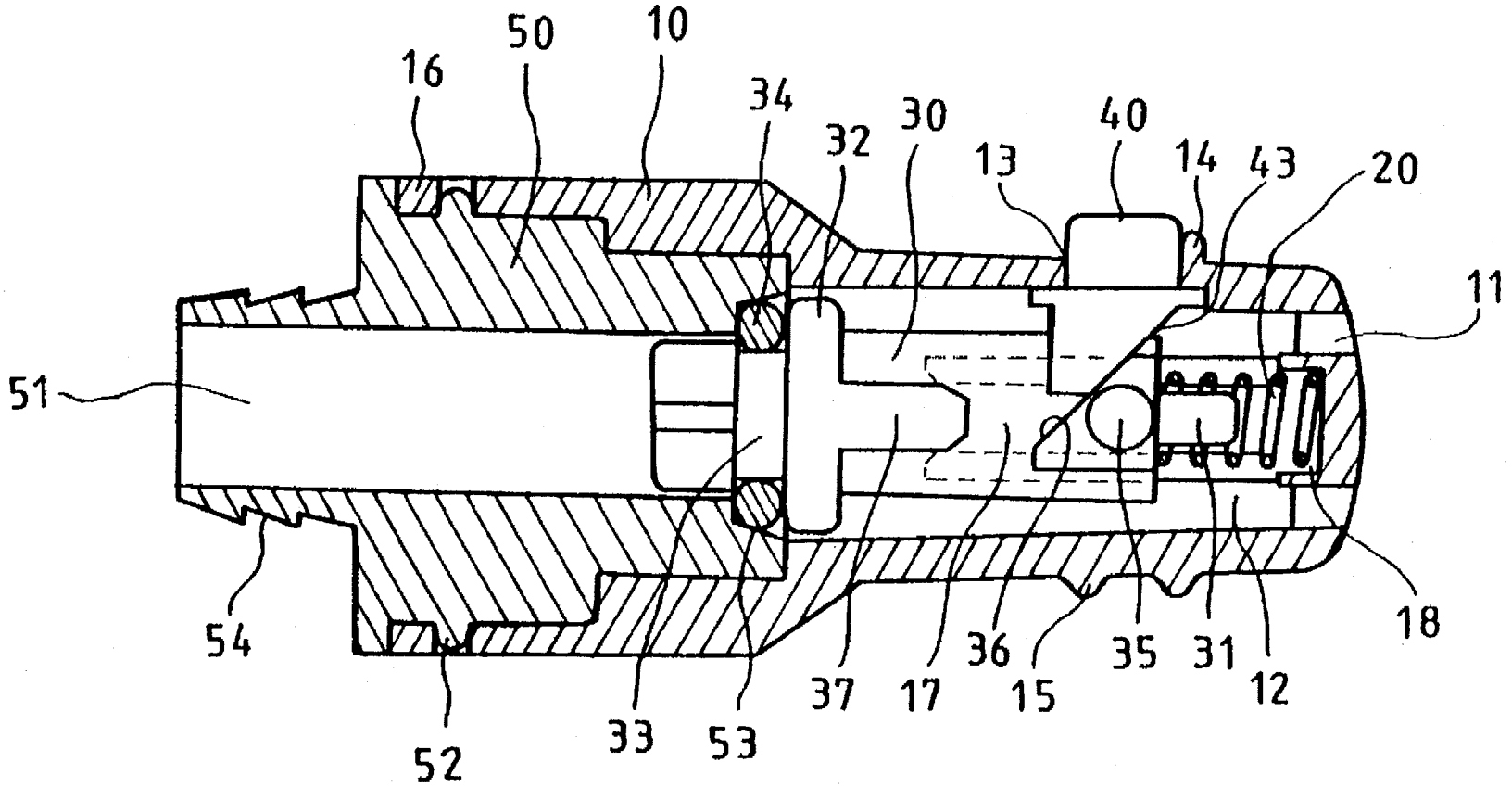
FIG. 4 is a sectional view of the present invention.
Figure 5:
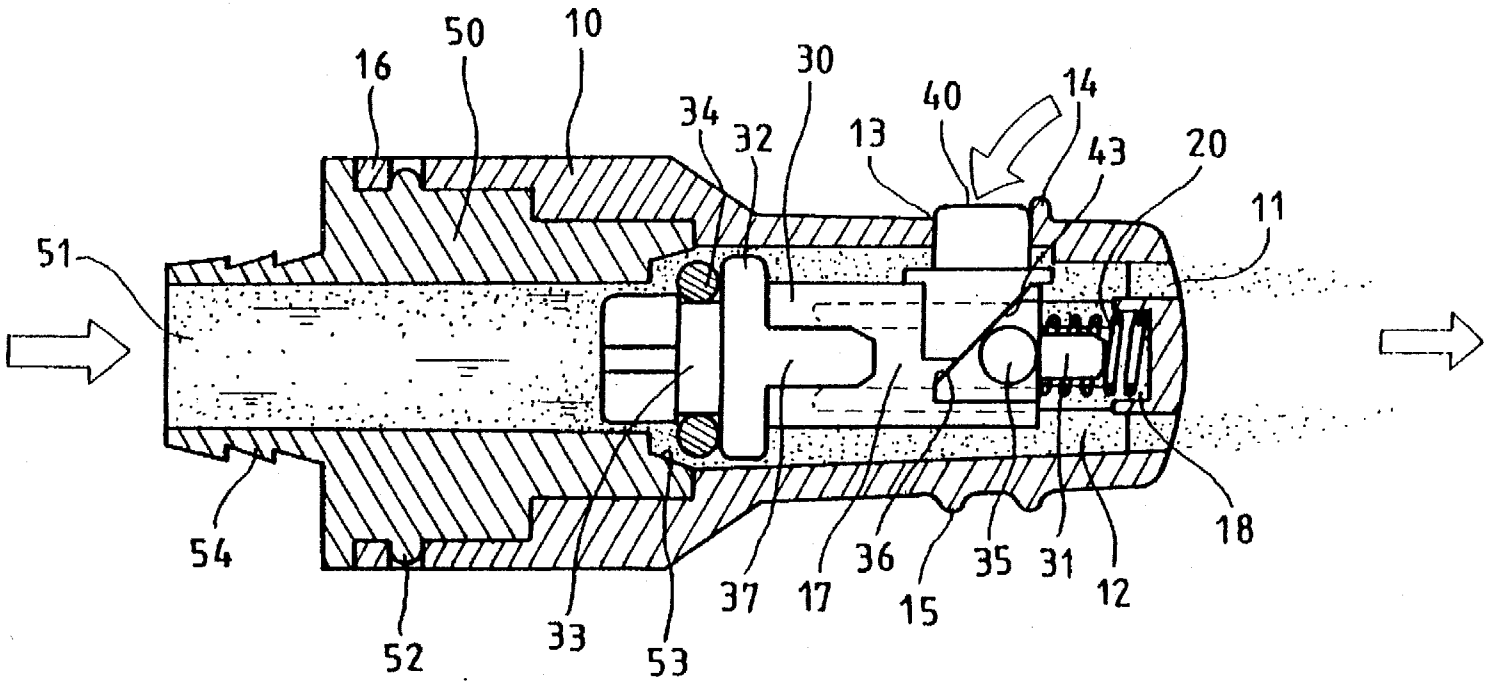
FIG. 5 illustrates the working principle of the present invention.

With reference to the drawings and in particular to FIGS. 3 and 4, the valve for a water dispenser according to the present invention comprises a housing 10, a resilient member 20, a slide 30, a button 40 and an inlet connector 50.

Figure 6:
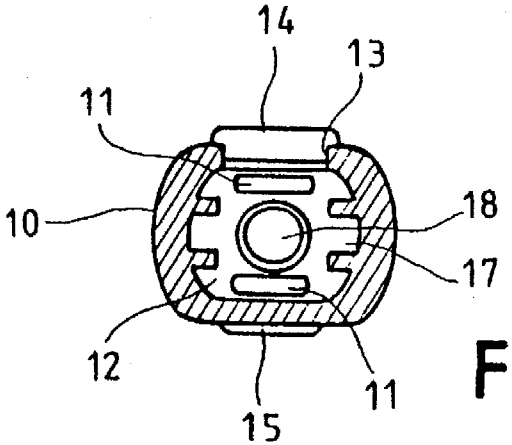
FIG. 6 is a cross sectional view of the front end of the housing.
Figure 7:
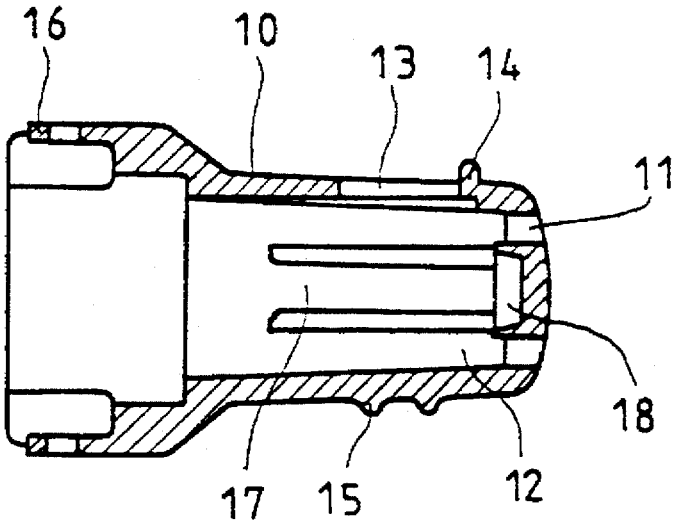
FIG. 7 is a longitudinal sectional view of the front end of the housing.

As shown in FIGS. 6 and 7, the housing 10 is a hollow member formed with two outlets 11 at the front end and an opening 13 at the top. The outlets 11 and the opening 13 are in communication with the interior 12 of the housing 10. The front end of the housing 10 has an elongated projection 14 at the upper surface and two elongated protuberances 15 at the lower surface. The rear end of the housing 10 has two resilient tongues 16 at the upper and lower sides each formed with a hole. The interior 12 of the housing 10 is formed with two opposite longitudinal grooves 17. The inner side of the front end of the housing 10 has a recess 18 at the central portion.

The resilient member 20 is a spring made of stainless steel having an end adapted to be received in the recess 18 of the housing 10.

Figure 8:
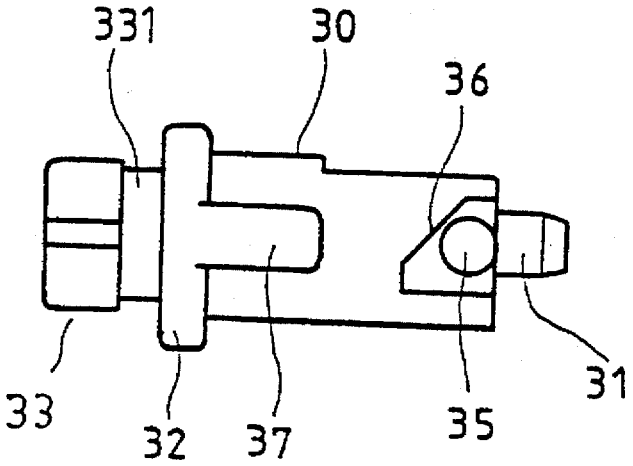
FIG. 8 is a side view of the slide.

As illustrated in FIG. 8, the front portion of the slide 30 is provided with two portrusions at two opposites sides each formed with an inclined edge 36. Further, the front portion of the slide 30 has two aligned arms 35 extending outwardly from the two protrusions and a longitudinal cylindrical end 31 adapted to fit into the other end of the spring 20. The rear portion 33 of the slide 30 is formed with a neck 331. The intermediate portion of the slide 30 has a ciruclar flange 32 adjacent to the neck 331 and two longitudinal ribs 37 at two opposite sides. A O-ring is fitted in the neck 331 of the slide 30.

Figure 10:
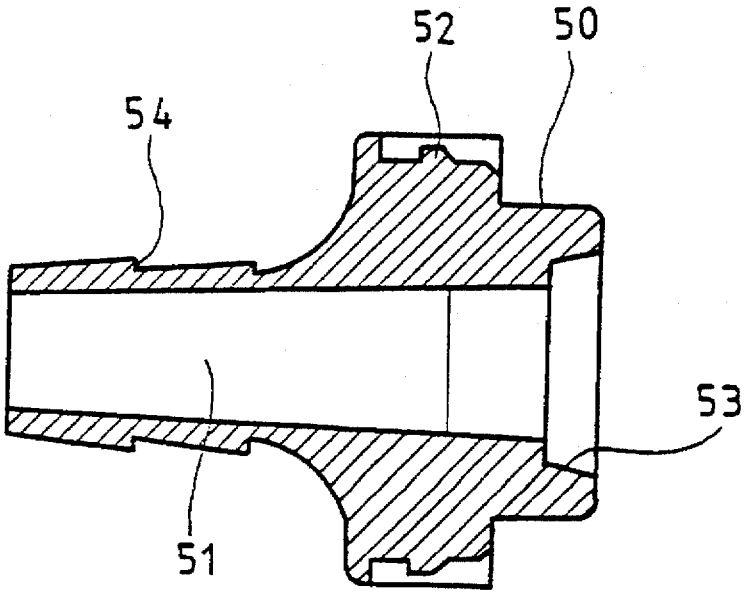
FIG. 10 is a longitudinal sectional view of the inlet connector.

As may be seen in FIG. 10, the inlet connector 50 is a tubular member having a longitudinal passage 51, two protuberances 52 at the upper and lower sides adapted to engage with the holes of the resilient tongues 16 of the housing, a circular recess 53 at the end adapted to engage with the O-ring 34, and a plurality of annular teeth 54 at the other end for connecting with a flexible tube (not shown).

Figure 9:
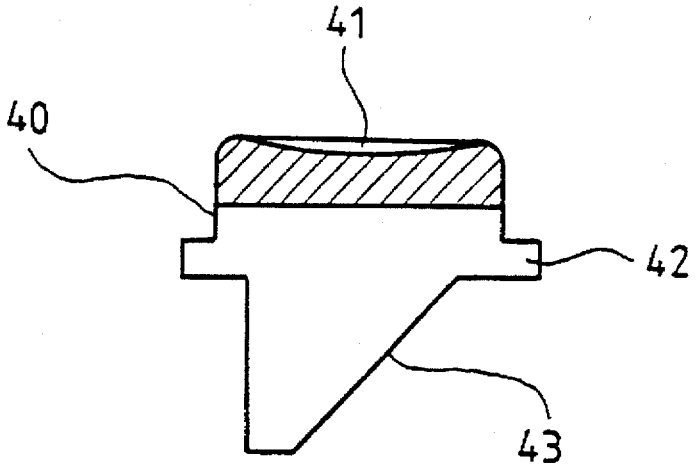
FIG. 9 is a sectional view of the button.

Referring to FIG. 9, the button 40 has a rectangular portion 41, two stop arms 42 extending horizontally outwardly from two opposite sides of the rectangular portion 41, and two legs depending downwardly from the rectangular portion 41. The legs are formed with an inclined edge 43 adapted to engage with the inclined edge 36 of the slide 30.

In assembly, the spring 20 is arranged within the housing 10 with its one end received in the recess 18 of the housing 10. Then, the slide 30 is inserted into the housing 10 with its longitudinal cylindrical end 31 fitted into the other end of the spring 20 and its arms 35 and ribs 37 slidably engaged with the grooves 17 of the housing 10. Thereafter, the button 40 is arranged within the housing 10 with the upper part of its rectangular portion 41 protruded upwardly out of the opening 13 of the housing 10 and the inclined edges 43 of its legs engaged with the inclined edge 36 of the slide 30. Then, the inlet connector 50 is fitted into the housing 10 with its circular recess 53 engaged with the O-ring 34 and its protuberances 52 fitted into the holes of the resilient tongues 16 of the housing 10.

The valve according to the present invention is put into the mouth of an user. As the button 40 is pressed by the teeth of an user, the slide 30 will be forced to go further into the housing 10 thereby moving the O-ring 34 away from the circular recess 53 of the inlet connector 50 and therefore enabling water to flow through the passage 51 of the inlet connector 50 and the interior 12 of the housing 10 into the mouth of the user. The elongated projection 14 and protuberances 15 of the housing 10 are used for preventing the valve from slipping off the teeth of the user. When the button 40 is released, the spring 20 will push the slide 20 outwardly thus lifting the button 40 on one hand and pushing the O-ring 34 against the circular recess 53 of the inlet connector 50 to close the passage 51 of the inlet connector 50.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A valve for a water dispenser comprising:

a housing formed with outlets at a first end thereof and an opening at a top thereof, said outlets and said opening being in communication with interior of said housing, said first end of said housing having an elongated projection at an upper surface thereof and two elongated protuberances at a tower surface thereof, a second end of said housing having a resilient tongues, the interior of said housing being formed with two opposite longitudinal grooves;

a resilient member disposed within said housing and having an end bearing against said first end;

a slide having a front portion provided with two portrusions at two opposite sides thereof each formed with an inclined edge, two aligned arms each extending outwardly a respective one of said protrusions, and a longitudinal cylindrical end adapted to fit into another end of said resilient member, a rear portion of said slide being formed with a neck, said intermediate portion of said slide having a ciruclar flange adjacent to said neck and two longitudinal ribs at two opposite sides thereof, and a O-ring being fitted in said neck of said slide;

a button having a body portion partly protruded out of said opening of said housing, said body portion being formed with two stop arms extending horizontally outwardly from two opposite sides of said body portion, and two legs depending downwardly from said body portion, said legs being formed with an inclined edge adapted to engage with said inclined edge of said slide; and an inlet connector having a longitudinal passage, two protuberances at an upper and lower sides thereof adapted to engage with said resilient tongues of said housing, a circular recess at an end thereof adapted to engage with said O-ring, and a plurality of annular teeth at another other end thereof.

2. The valve for a water dispenser as claimed in claim 1, wherein said resilient member is a spring made of stainless steel.

* * * * *